US008366067B2

(12) United States Patent
Felton

(10) Patent No.: US 8,366,067 B2
(45) Date of Patent: Feb. 5, 2013

(54) UNIVERSAL MOUNTING SYSTEM

(76) Inventor: John Reed Felton, Wauwatosa, WI (US)

( * ) Notice: Subject to any disclaimer, the term of this patent is extended or adjusted under 35 U.S.C. 154(b) by 321 days.

(21) Appl. No.: 12/612,535

(22) Filed: Nov. 4, 2009

(65) Prior Publication Data

US 2010/0108837 A1 May 6, 2010

Related U.S. Application Data

(60) Provisional application No. 61/111,631, filed on Nov. 5, 2008.

(51) Int. Cl.
*F16B 2/06* (2006.01)
*F16B 2/02* (2006.01)

(52) U.S. Cl. ..... 248/316.1; 248/223.41

(58) Field of Classification Search ..... 248/221.11, 248/223.41, 229.1, 225.11, 187.1, 316.1, 248/222.14, 229.14, 224.51, 231.85; 312/265.6, 312/265.5, 257.1; 42/124, 125, 127
See application file for complete search history.

(56) References Cited

U.S. PATENT DOCUMENTS

| | | | | |
|---|---|---|---|---|
| 4,155,609 | A | 5/1979 | Skafte et al. | |
| 4,437,712 | A | 3/1984 | Wissinger | |
| 5,050,832 | A | 9/1991 | Lee et al. | |
| 5,787,630 | A * | 8/1998 | Martel | 42/125 |
| 6,318,672 | B1 | 11/2001 | Traylor | |
| 6,332,659 | B1 | 12/2001 | Cook et al. | |
| 6,808,334 | B2 * | 10/2004 | Nicoletti | 403/170 |
| 6,923,412 | B2 * | 8/2005 | Wooten et al. | 248/229.1 |
| 6,988,846 | B2 * | 1/2006 | Vogt | 248/223.41 |
| 7,185,862 | B1 * | 3/2007 | Yang | 248/187.1 |
| 7,493,721 | B2 * | 2/2009 | Swan | 42/125 |
| 7,823,316 | B2 * | 11/2010 | Storch et al. | 42/90 |
| 2001/0006319 | A1 | 7/2001 | Dopp et al. | |
| 2006/0091271 | A1 | 5/2006 | Nowak | |
| 2008/0036342 | A1 | 2/2008 | Heyer | |
| 2008/0173778 | A1 | 7/2008 | Mertens | |

* cited by examiner

*Primary Examiner* — Tan Le
(74) *Attorney, Agent, or Firm* — Absolute Technology Law Group, LLC

(57) ABSTRACT

This invention is a wall mounting system which securely mounts panels and displayed objects to a wall, using a variety of components which can be efficiently attached to a universal rail plate which is standard to a particular embodiment of the system.

16 Claims, 7 Drawing Sheets

UNIVERSAL MOUNTING SYSTEM

CROSS-REFERENCE TO RELATED APPLICATIONS

This application claims priority to U.S. Provisional Application No. 61/111,631 filed on Nov. 5, 2008.

FIELD OF INVENTION

This invention relates generally to the field of wall mounting systems and more specifically a system utilizing a uniquely contoured common universal rail plate component.

GLOSSARY

Figure 1:
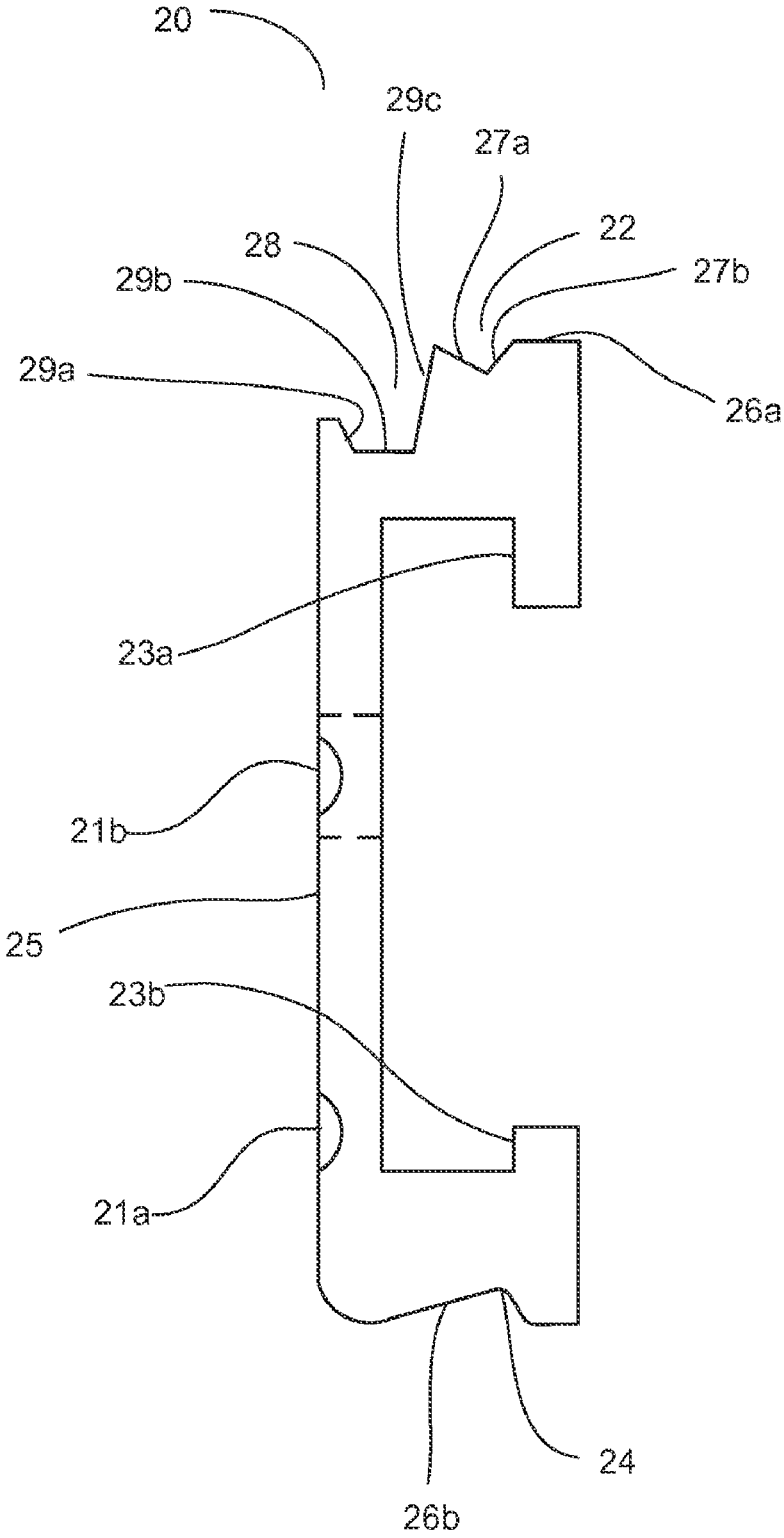
FIG. 1 illustrates side perspective view of a universal rail plate.

As used herein, the ter "wall" means any plane on which an object can be mounted in a perpendicular plane. As used herein, a wall may be any vertical or horizontal plane, such as with a traditional wall in a building, a wall within a structure such as a cabinet, a base of structure, and a mountable interface such as a display.

As used herein the term "universal rail plate" means any structure configured to operate as a rail upon which multiple types of components can be selectively mounted, and which includes one or more triangular or semi-hexagonal grooves.

As used herein, the term "hexagonal groove" means a groove having a substantially horizontal lower surface adjoining one or more angled or vertical surfaces. A horizontal groove may be adapted to securely rest on another component.

As used herein the term "mounted object" means panels, cabinetry, ornamentation, instruments, fixtures or any other object capable of being mounted securely to a universal rail plate using the system described herein.

As used herein the term "ratchet and pawl system" means a mechanical device that permits motion in one direction only. The ratchet may be a wheel with slanting teeth or frictional engagement component. The pawl is a lever tangential to the wheel with one end resting on the teeth. When the wheel rotates one way, the pawl slides over the teeth; when the wheel rotates the other way, the pawl catches in the teeth.

As used herein the term "mortised panel" means a panel which includes a hole, groove, cavity or dado which may be of any shape or elongated.

As used herein, the term "ferrous flipper" means a pivotal magnetic component.

A used herein, the term "eccentric disk" means a rotational plate which is either mounted to another component at a point other than its center or which is of a shape other than a perfect circle.

As used herein, the term "engaging contour" means a contour of a size and shape sufficient to balance the bottom surface of an object on a ridge, clip, frame, protuberance, or other object.

BACKGROUND

Walls and panels which accommodate cabinet structures and display fixtures are common in residential and commercial settings, and generally are regarded as permanent or semi-permanent fixtures due to the difficulty of installing and un-installing them. For example, cabinet structures are generally square, rectangular and/or contoured structures which are professionally installed taking into account that some floors and walls have uneven (high or low) spots, which will affect the installation. It is necessary to locate these uneven areas and shim or scribe cabinets in order to make the installation plumb, level, stable and/or square.

Cabinet structures are installed in a variety of ways, but a common installation technique generally involves designing a cabinet layout with minimal versatility. Once installed, cabinets cannot be easily repositioned without damage to walls and/or the floor.

Leveling is an important process in the installation of cabinetry. Leveling is the act of finding a line or surface to which, at every point, a vertical or "plumb line" is perpendicular. A plumb line is a vertical line or plane; that is, a straight line or plane which is perpendicular to a true level at a given point and hence perpendicular to the horizon at that point. It is generally very important to install cabinetry along a plumb line so that cabinetry units are installed evenly relative to each other in both the vertical and horizontal axes.

Generally the process of leveling cabinetry is accomplished by tapping on the walls to find the studs. All the studs must be marked because the studs are needed to support the screws, bolts, nails or other components which hold cabinetry and cabinetry support structures in place. All of the doors and drawers must be removed from the cabinetry and installation is usually commenced at a corner and/or line that has been previously marked. Fillers may be needed to take up odd dimensions, and valences and trimming may also be required.

The process of leveling often requires two laborers, one to hold the cabinetry in place, and the other to determine if the cabinets are level using a leveling tool. Additionally, during the installation process, special tools such as jacks, supports constructed from scrap wood and ledger boards may be used to support and level cabinets.

Floors and wads are rarely plumb and level, so "shims" constructed of the same material as the cabinets or from visually hidden components are often constructed and inserted under the frame of the units to level floor cabinets.

If an error is made during installation and cabinets are not level, cabinets must often be removed and reinstalled, damaging wads and setting back the timeline for completion of a project. Multiple adjustments and installations may be necessary to bring doors and cabinetry into alignment and multiple alignments can also damage the cabinetry. It is often necessary to touch up nicks and scratches caused during installation and reinstallation of cabinetry units.

An additional problem in the installation of cabinetry and other wall and floor structural units is that, in the U.S., cabinets, once installed in rented buildings or structures inhabited by a lessee, may legally become real estate "fixtures" owned by the landlord. Landlord/tenant laws and leases often reflect this concern.

A final problem in the prior art is that it is often desirable to suspend structures other than cabinets from walls, such as storage units, displays, mounting boards, ornamentation and other components. These components must be securely attached, and since hanging or suspending them may also damage walls, it is a problem to selectively attach and vary them. For example, it is advantageous for residents, industrial facilities, stores, schools, retail establishments, marketing venues, cultural and recreational facilities and other businesses to securely attach and have the flexibility to reposition wall components and structures with minimal labor and damage to walls and floors.

DETAILED DESCRIPTION OF EMBODIMENTS OF THE INVENTION

For the purpose of promoting an understanding of the present invention, references are made in the text hereof to embodiments of a universal mounting system. It should nevertheless be understood that no limitations on the scope of the invention are thereby intended. One of ordinary skill in the art will readily appreciate that modifications such as the dimensions, size, and shape of the components, alternate but functionally similar materials from which an universal mounting system is made, and the inclusion of additional elements are deemed readily apparent and obvious to one of ordinary skill in the art, and all equivalent relationships to those illustrated in the drawings and described in the written description do not depart from the spirit and scope of the present invention. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed apparatus or manner.

It should be understood that the drawings are not necessarily to scale, emphasis instead being placed upon illustrating the principles of the invention. In addition, in the embodiments depicted herein, like reference numerals in the various drawings refer to identical or near identical structural elements.

Moreover, the terms "substantially" and "approximately" as used herein may be applied to modify any quantitative representation that could permissibly vary without resulting in a change in the basic function to which it is related.

Referring now to the drawings, FIG. 1 shows a side perspective view of one embodiment of a universal rail plate 20 which used the wall mounting system 100 (shown in FIG. 3) describe herein. In the embodiment shown universal rail plate 20 is made from a single piece of extruded metal (such as aluminum, plastic, fiberglass, steel, copper or metal alloys). In the embodiment shown, universal rail plate 20 is comprised of an elongated side 25, an upper surface 26*a* and a lower surface 26*b*.

Upper surface 26*a* further includes triangular groove 22 with inner triangular groove surfaces 27*a*, 27*b*. In the embodiment shown, triangular groove 22 is adapted to receive ferrous flipper 37 (shown in FIG. 2) which is a pivotal magnetic component which secures rail mounting system accessory clip 30 (shown in FIG. 2) to universal rail plate 20 when positioned at an angle.

In the embodiment shown, surface 27*a* and surface 27*b* are positioned at an angle of 90 to 100 degrees of each other.

Lower surface further includes lower triangular groove 24.

Figure 4:
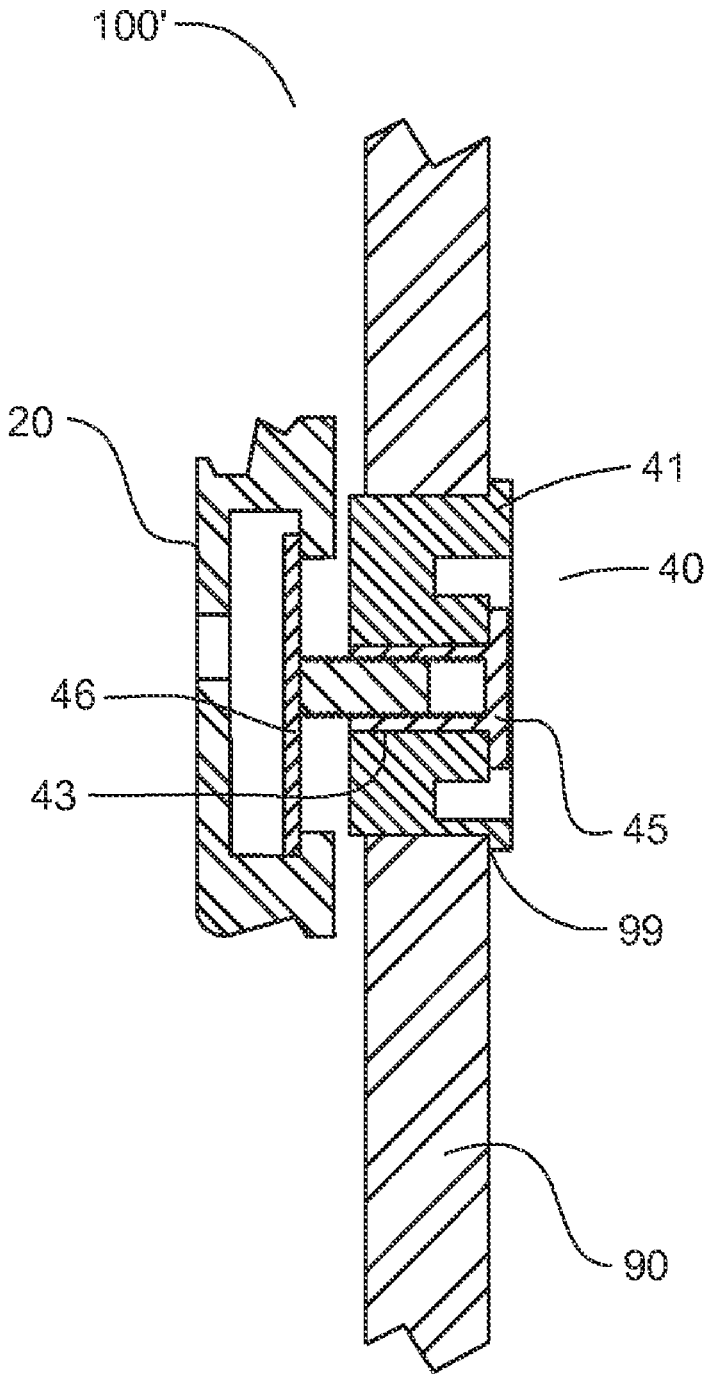
FIG. 4 illustrates a sectional side view of universal rail mounting system panel mounting clip mounted within universal rail plate.

FIG. 1 further illustrates semi-hexagonal groove 28 which is adapted to receive stud assembly 46 (shown in FIG. 4) of panel mounting clip 40 (shown in FIG. 4). Semi-hexagonal groove 28 surfaces 29*a*, 29*b* and 29*c* are visible in the embodiment shown, with groove surface 29*a* positioned at an angle of 110 to 160 degrees relative to hexagonal groove surface 29*b*. Surface 29*c* is positioned at angle of 90-120 degrees relative to horizontal surface 29*b*.

In the embodiment shown, universal rail plate 20 further includes securing lips 23*a* and 23*b* which are protrusions to secure universal rail plate 20 to various mounting components mounted by a universal rail structure discussed herein. The embodiment shown further includes apertures 21*a* and 21*b* for mounting universal rail 20 on a wall. Other embodiments may include more or fewer mounting apertures, or omit mounting apertures.

In various embodiments, universal mounting rail may be an Eschutchen plate, a plate with one or more protuberances for mounting, a contoured plate, a recessed plate, a plate with singular or multiple apertures, or a plate with elongated apertures. The universal mounting rail plate 20 may also be a structural component of a door, cabinet or wall.

Figure 3:
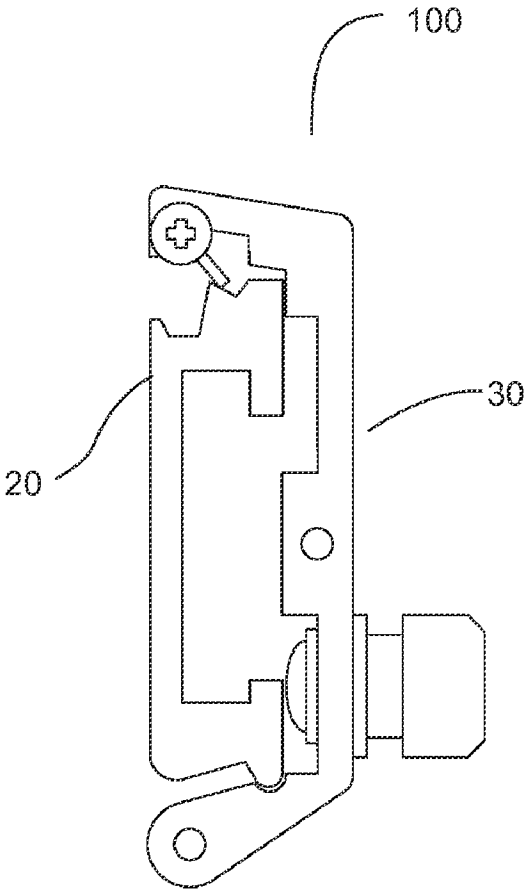
FIG. 3 illustrates a universal rail mounting system with accessory dip mounted within universal rail plate.
Figure 2:
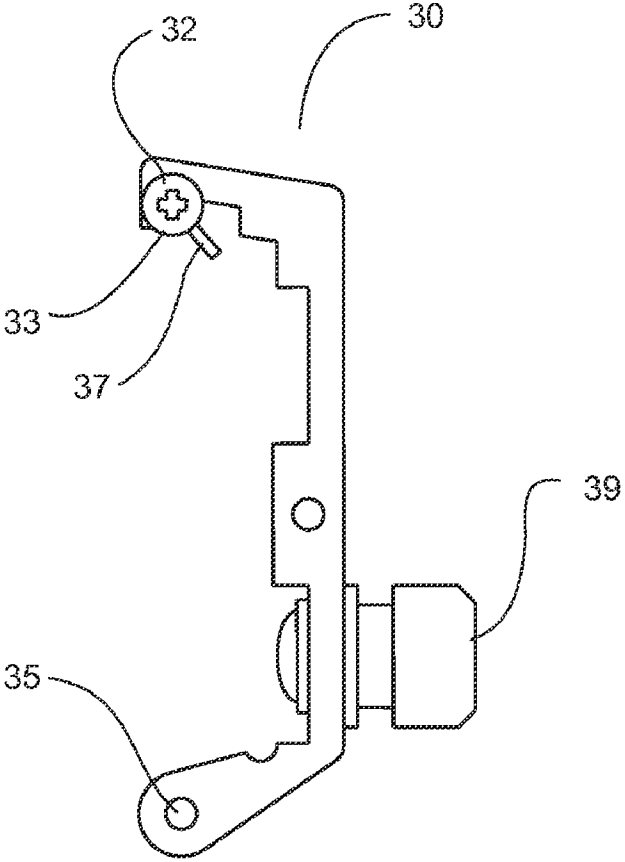
FIG. 2 illustrates a universal rail mounting system accessory dip.

FIG. 2 illustrates one embodiment of an accessory dip 30 used with universal rail mounting system 100 (shown in FIG. 3). In the embodiment shown, accessory dip 30 consists of contoured ferrous flipper 37 which pivots and is pivotally attached to a pivotal structure 32 which rotates at pivot point 33 and which be manipulated by a magnet (not shown) to disengage mounted objects. In various embodiments pivotal structure 32 may be a boss (which is a structure which has a thicker part of a shaft at a rotation point which operates as a securing or a retention point), a screw, a lynch pin or a rod. Accessory dip 30 further includes accessory mounting protrusion 39 on which an accessory (such as a cabinet, display shelf or other object) can be securely mounted. Ferrous flipper 37 retains accessory dip 30 within universal mounting rail plate 20, and allows accessory clip 30 to bear weight of up to 225 pounds. Ferrous flipper 37 can be engaged and disengaged without interfering the movement of accessory clip 30 within a path parallel to the orientation universal mounting rail plate 20 (shown in FIG. 1). Accessory clip 30 may further include or more receiving apertures 35 for mounting panels and other structures as an addition or alternative to mounting protrusion 39.

FIG. 3 illustrates universal rail mounting system 100 with accessory clip 30 mounted within one embodiment universal rail plate 20.

FIG. 4 illustrates a sectional side view of one embodiment of a universal rail mounting system 100' utilizing panel mounting dip 40, instead of accessory dip 30 (shown in FIG. 2), with universal rail plate 20. In the embodiment shown, panel mounting clip 40 consists of eccentric disk 41 encased within a hole 99 through panel 90. Eccentric disk 41 is attached to plate 43 with sex bolt 45. Stud assembly 46 engages universal rail plate 20 and eccentric disk 41. In the embodiment shown panel 90 is a cabinet wall but can be any wall.

Figure 5:
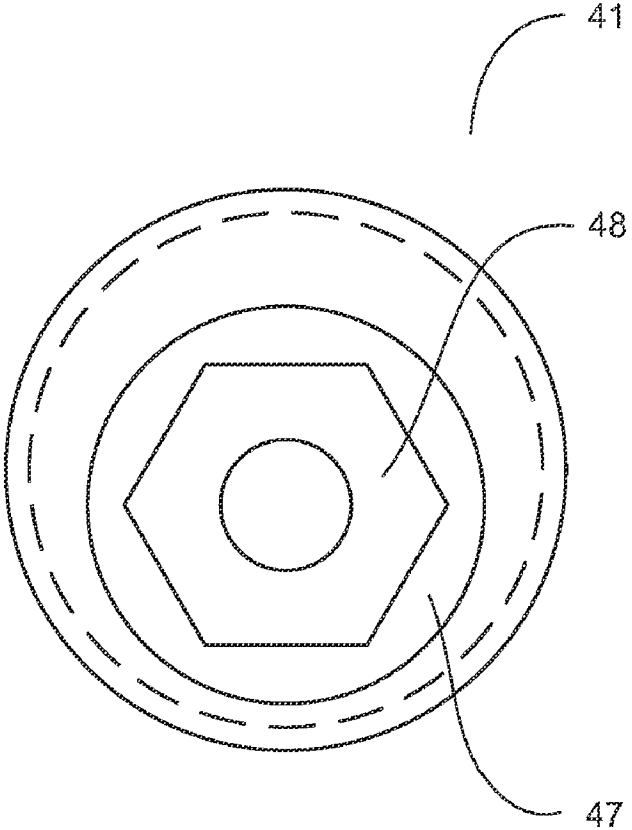
FIG. 5 illustrates front view of concentric disk component of universal rail mounting clip, embedded in panel.

FIG. 5 is a front view of eccentric disk 41 which is embedded in panel 90 (shown in FIG. 4) and which is a component of universal rail panel mounting clip 40 (shown in FIG. 4). In the embodiment shown eccentric disk 41 is made of acetyl plastic, but can be of any plastic, metal, resin, rubber alloy, recycled or other material. In the embodiment shown, eccentric disk 41 has an irregular circular groove 47 positioned off-center within eccentric disk 41. Irregular circular groove 47 surrounds hexagonal protuberance 48 into which a standard, multi-faceted socket wrench can be applied to rotate eccentric disk 41 to reposition panel 90 (shown in FIG. 4) in relation to universal wall rail, and/or a horizontal surface such as a floor. In one exemplary embodiment universal rail mounting system 100' (shown in FIG. 4) with panel mounting clip 40 and universal rail plate 20 (not shown) is used to level cabinets relative to a floor. An aperture to accommodate the female portion of sex bolt 45 (shown in FIG. 4) is positioned within hexagonal protuberance 48.

Figure 6:
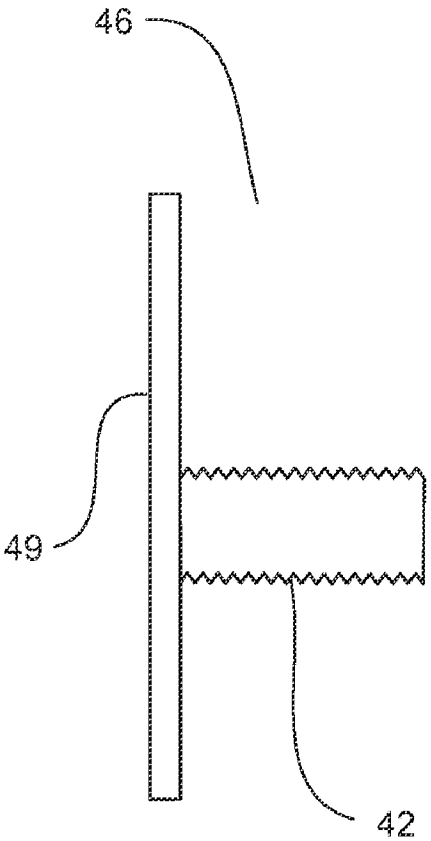
FIG. 6 illustrates a plate with stud assembly used with a panel mounting clip.

FIG. 6 illustrates the stud assembly 46 used with panel mounting clip 40. Stud 42 is the male portion of sex bolt 45 (shown in FIG. 4) and is attached to the plate 43 by welding and other means known in the art. Plate 43 is configured to fit into a groove or other contour of a universal rail plate 20, as illustrated in FIGS. 4 and 7.

Figure 7:
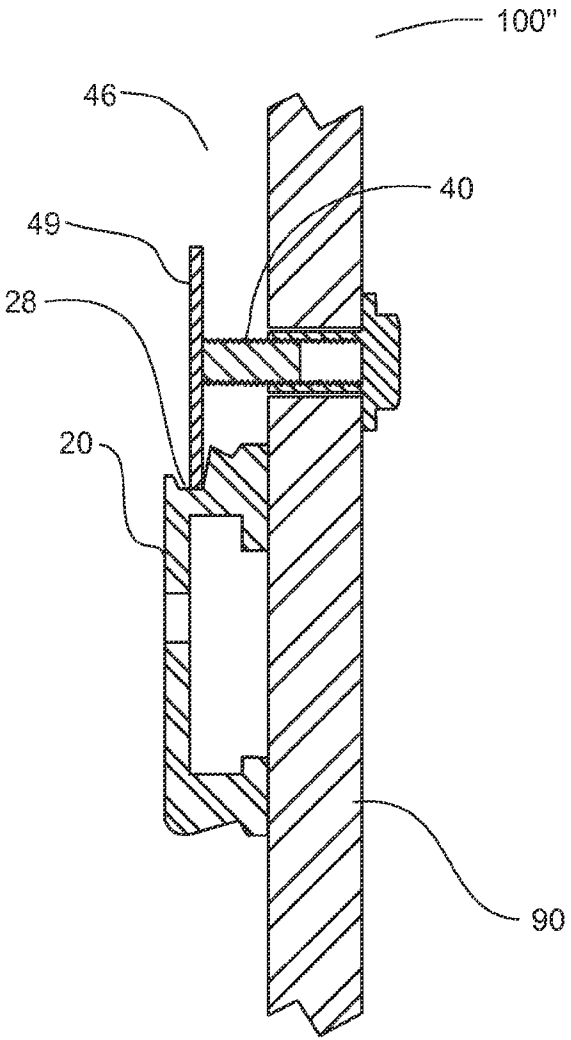
FIG. 7 illustrates an alternate embodiment of universal rail plate in use with an eccentric circular metal plate mounted by a sex bolt embedded in panel, which is mounted in a groove at the top of universal rail plate.

FIG. 7 illustrates an alternate embodiment of a universal rail mounting system 100" with universal rail plate 20 used with stud assembly 46 which is mounted by a sex bolt 45 embedded in panel 90, which is mounted in a groove at the top (semi-hexagonal groove 28) of universal rail plate 20. This embodiment allows a mounted object (such as a cabinet) to be positioned relative to a horizontal plane (e.g., leveled) by rotating threaded stud 42 which raises and lowers the mounted object by rotation of the stud assembly 46, which in the embodiment shown in made of resilient metal.

Figure 8:
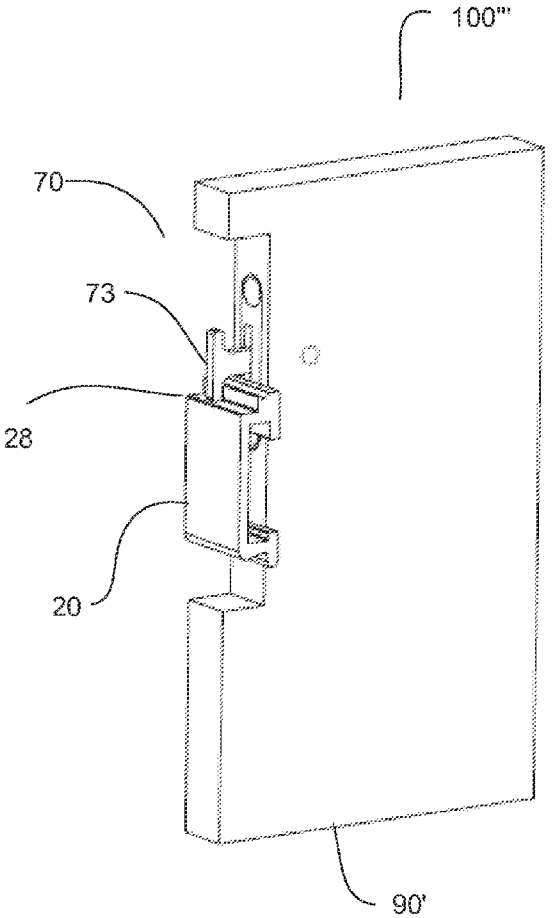
FIG. 8 illustrates an alternate embodiment of the cabinet mounting system using retractable latch assembly and a universal rail plate.

FIG. 8 illustrates an alternate embodiment of universal rail mounting system 100' using retractable latch assembly 70 and a universal rail plate 20. In the embodiment shown in FIG. 8, a retractable latch 73 is mounted within panel 90'. Retractable latch 73 engages semi-hexagonal groove 28 of universal rail plate 20 to secure a mounted object to a universal rail plate 20. Retractable latch 73 selectively locks into place to affix a mounted object securely to universal rail plate 20. In the embodiment shown, a retractable latch 73 is actuated by an embedded drive wheel (such as a ratchet and pawl or other gear type mechanism with or without teeth or frictional engaging components) used to lock and unlock retractable latch 73. One exemplary embodiment uses a ratchet and pawl system. This embodiment conceals hardware and mounting components from view, and is adapted for both for use with both left and right handed panels.

Figure 9:
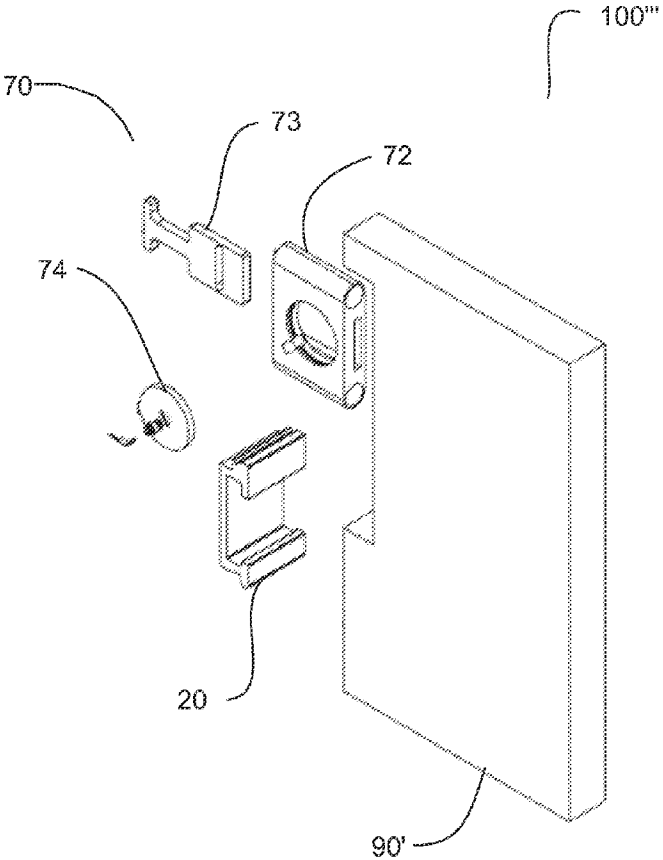
FIG. 9 illustrates an exploded view alternate of the cabinet mounting system using retractable latch assembly and mortised panel.

FIG. 9 illustrates an exploded view alternate of the universal rail mounting system 100'" using retractable latch assembly 70 mortised into a panel 90 and mounted on a universal rail plate 20 showing drive wheel 74, retractable latch 73, drive wheel and latch housing assembly 72, universal rail plate 20 and panel 90'. The mortised panel 90' is adapted to receive and encase drive wheel and latch housing assembly 72.

Figure 10:
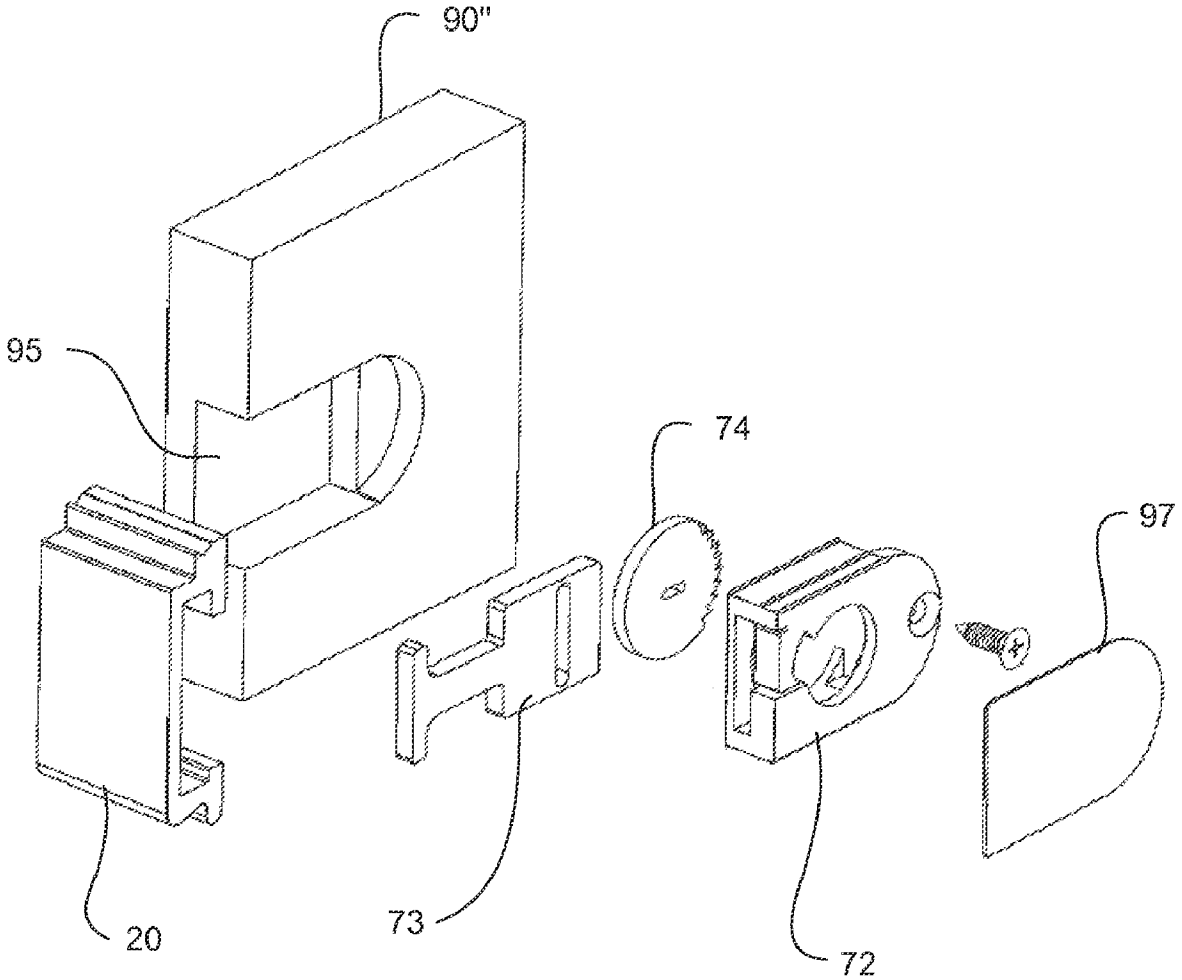
FIG. 10 illustrates an exploded view alternative "flush mount" assembly embodiment.

FIG. 10 illustrates an exploded view alternative retractable latch assembly 70 which is "flush mount" with panel 90" for ease of manufacturing. Components are machined so that they are flush with the surface of a panel 90" so that panels 90" can be stacked and easily stored for inventory storage and shipping. All component parts are embedded in machined panel recess 95. These component parts include a universal rail plate 20 showing drive wheel 74, retractable latch 73, drive wheel and latch housing assembly 72, and panel 90". These components are concealed with finish cover plate 97 which covers and/or protects component parts.

What is claimed is:

1. A cabinet mounting apparatus comprised of:

a C-shaped universal rail plate free from any seam and comprised of an elongated vertical side surface including at least one wall-mounting aperture, a top outer surface, a bottom outer surface, wherein the transition between said elongated vertical side surface and said bottom outer surface is curved, a top inner horizontal surface terminating in a vertical securing lip parallel to said elongated vertical side, and a bottom inner horizontal surface terminating in a vertical securing lip parallel to said elongated vertical side; said top outer surface having a triangular groove and a semi-hexagonal groove comprised of a first groove surface, a second groove surface and a third groove surface; and said bottom outer surface having an engaging contour.

2. The apparatus of claim 1 wherein said triangular groove is comprised of a first inner surface and second inner surface which form an angle of 90 to 100 degrees.

3. The apparatus of claim 1 which further includes a universal rail mounting accessory clip releasably secured to said engaging contour.

4. The apparatus of claim 3 wherein said universal rail mounting accessory clip further includes at least one ferrous flipper.

5. The apparatus of claim 1 which further includes at least one eccentric disk releasably secured to said securing lip.

6. The apparatus of claim 5 wherein said at least one eccentric disk is held into place with a sex bolt.

7. The apparatus of claim 5 wherein said at least one eccentric disk further includes a hexagonal protuberance which can be rotated using a wrench.

8. The apparatus of claim 3 wherein said universal rail mounting accessory clip further includes at least one boss.

9. The apparatus of claim 1 which further includes at least one retractable latch assembly releasably secured to said securing lip.

10. The apparatus of claim 9 wherein said at least one retractable latch assembly includes a ratchet and pawl assembly.

11. The apparatus of claim 9 wherein said at least one retractable latch assembly further includes a drive wheel.

12. The apparatus of claim 1 which further includes at least one mortised panel releasably secured to said securing lip.

13. The apparatus of claim 9 wherein said at least one retractable latch assembly is encased within a mortised panel.

14. The apparatus of claim 11 wherein said drive wheel is encased within a mortised panel.

15. The apparatus of claim 14 which further includes a finish cover plate which encases one or more components selected from a group consisting of a drive wheel, a retractable latch, and a latch housing assembly.

16. The apparatus of claim 1 wherein said first groove surface is positioned at an angle of 110 degrees to 160 degrees relative to said second and third groove surfaces and said second groove surface is positioned at an angle of 90 degrees to 120 degrees relative to said third groove surface.

* * * * *